US007028424B2

(12) United States Patent
Arroyo

(10) Patent No.: US 7,028,424 B2
(45) Date of Patent: Apr. 18, 2006

(54) ARTICLE MARKER

(76) Inventor: John J. Arroyo, 8631 Emerson Ct., Denver, CO (US) 80229

( * ) Notice: Subject to any disclaimer, the term of this patent is extended or adjusted under 35 U.S.C. 154(b) by 0 days.

(21) Appl. No.: 10/410,833

(22) Filed: Apr. 9, 2003

(65) Prior Publication Data

US 2004/0148827 A1 Aug. 5, 2004

Related U.S. Application Data

(63) Continuation-in-part of application No. 10/358,532, filed on Feb. 4, 2003.

(51) Int. Cl.
*G09F 3/00* (2006.01)

(52) U.S. Cl. ..... 40/307; 40/306

(58) Field of Classification Search ..... 40/306, 40/310, 324, 666; D7/396.1; 215/365; 220/359.2, 220/700, 703, 718, 733, 259.2; 24/462, 545, 24/564

See application file for complete search history.

(56) References Cited

U.S. PATENT DOCUMENTS 940,204 A * 11/1909 Simpson ..... 239/33
2,171,350 A * 8/1939 Anderson ..... 40/324
2,535,262 A * 12/1950 Brownsey ..... 40/340
2,614,406 A * 10/1952 Carpenter ..... 220/718
3,354,564 A * 11/1967 Falcone et al. ..... 40/658
4,762,229 A 8/1988 Wickre
4,961,510 A * 10/1990 Dvoracek ..... 220/713
5,261,176 A 11/1993 David et al.
5,339,549 A 8/1994 David et al.
5,358,770 A 10/1994 Evans
5,492,077 A 2/1996 Rose
5,581,921 A * 12/1996 Hutchens ..... 40/324
5,704,144 A 1/1998 Groth
5,799,815 A 9/1998 Lang
6,053,349 A 4/2000 Griggs, Jr. et al.
6,082,030 A 7/2000 Kesselring et al.
6,105,293 A 8/2000 Eason et al.
6,240,668 B1 * 6/2001 Clawson et al. ..... 40/665
6,332,285 B1 * 12/2001 Aaldenberg et al. ..... 40/641
6,446,829 B1 * 9/2002 Malvasio et al. ..... 220/697

FOREIGN PATENT DOCUMENTS

GB 2277314 * 10/1994 ..... 40/324

* cited by examiner

*Primary Examiner*—Lesley D. Morris
(74) *Attorney, Agent, or Firm*—John E. Reilly; Ellen Reilly

(57) ABSTRACT

A marker device for identifying an article or possessions including a tab member extending from a mounting member. The mounting member is adapted to be releasably secured to an article and is of inverted channel-shaped configuration. The tab member is preferably an outwardly extending portion capable of being gripped by an individual for easy placement and removal. Each marker device may be visibly distinct from another marker device due to a difference in color or a difference in indicia printed on the visual surface of the tab member.

10 Claims, 2 Drawing Sheets

ARTICLE MARKER

CROSS-REFERENCE TO RELATED APPLICATION

This application is a continuation-in-part application of Ser. No. 10/358,532, filed 4 February, 2003, for ARTICLE MARKER by John J. Arroyo.

BACKGROUND AND FIELD OF INVENTION

This invention relates to a marker device for identifying an article. More particularly, this invention relates to a device suitable for releasable mounting on an object for visual identification.

Misidentification of beverages and loss of beverage containers during parties, social engagements and even at home when there is more than one individual, is a common problem. Often during parties, several of the same type of beverages, including beverages contained within a metal can, will be opened by various individuals. Once the beverage is set down, it is almost impossible to identify the rightful owners of each beverage. If an individual picks up the wrong beverage, he may be exposed to contagious diseases. Further, individuals may place objects, such as, cigarette butts into the beverage container which another could inadvertently attempt to drink. Finally, the inability to identify a particular beverage results in a great deal of waste. In lieu of exposing oneself to a contagious disease, one may simply open up another beverage, leaving the prior, opened beverage to go to waste.

A marker device for metal cans and beverage glasses would alleviate the risk of contagious diseases as well as reducing the waste involved. This invention satisfies an unmet need for an inexpensive, easy to manufacture, easy to use marker device that enables an individual to visually identify a beverage container. Further, this device may also be used on glassware, clothing, kitchen utensils and any other personal article requiring identification.

SUMMARY OF THE INVENTION

It is therefore an object of the present invention to provide for a novel marking device to allow an individual to easily and visually identify his or her own possessions.

It is another object of the present invention to provide a marker device which can be reused a number of times.

It is another object of the present invention to provide a marker device that can be easily attached and removed from an article.

It is a further object of the present invention to provide a marker device that is easy and inexpensive to manufacture.

In accordance with the present invention, there is provided a marker device for identifying an article that broadly comprises a mounting member adapted to be releasably secured to a container having a circular drinking edge and a tab member having a thin, substantially flat crescentshaped portion, the crescent-shaped portion extending in a circumferential direction around a portion of the circular drinking edge of the container, and the crescent-shaped portion extends laterally outwardly from a lower end of the mounting member including a visibly distinct outwardly extending surface.

The marker device may be secured or mounted to the outside rim of a beverage container, the tab member extending outwardly from the beverage container, allowing for visual identification by an individual as well as easy attachment and removal from the container. The marker device may be easily placed on the outside rim of a beverage container by grasping the tab member and easily removed by grasping the same tab member for later use once the beverage is consumed. The marker includes means for readily identifying the particular marker and thus the particular can to which it can be connected. Such identifying means comprises a distinctive color, design and/or written indicia on the tab member of the marker.

There has been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF PREFERRED EMBODIMENT

The following describes the preferred embodiment of the invention.

Figure 1:
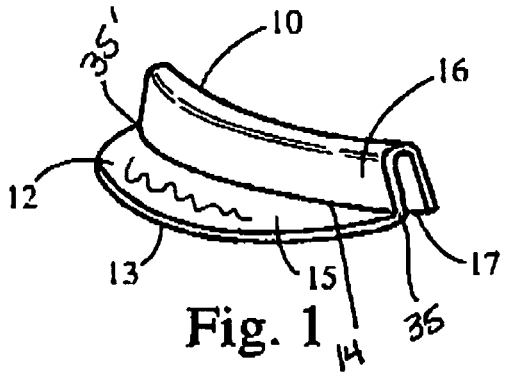
FIG. 1 is a front perspective view of a marker device in accordance with the present invention.
Figure 2:
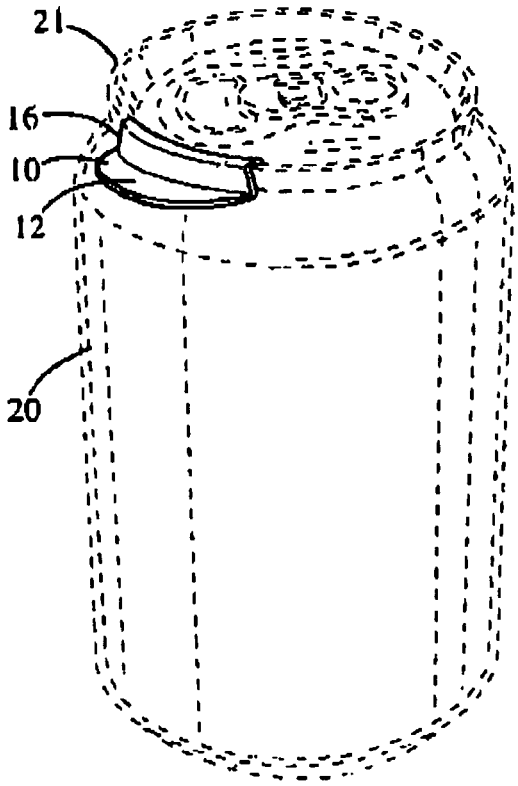
FIG. 2 is a perspective view of a beverage container showing the marker device according to the present invention as it is mounted on the outside rim of a beverage container.

Referring to FIG. 1, a marker device 10 for identifying an article comprises a tab member 12 which has a visibly distinct outwardly extending surface. A tab member preferably forms a crescent shape on its outside edge 13 and includes a flat upper surface 15 that may be embossed or die-cut with a name or design. The tab member 12 is connected to the base 17 of mounting member 16. Mounting member 16 is arcuate and of inverted channel-shaped cross-sectional configuration. The mounting member 16 has first and second side edaes 35. 35' and an exterior convex surface portion 14 which extends between the first and second side edges, the exterior convex surface portion 14 is disposed on the outside of a base structure or rim 21 as seen in FIG. 2. The tab member 16 extends laterally outwardly from the exterior convex surface portion 14. The inverted channel shape of mounting member 16 allows mounting member 16 to lock securely onto the base structure 21 as seen in FIG. 2.

Figure 3:
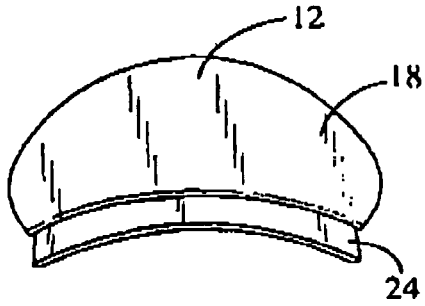
FIG. 3 is a bottom view of the marker device according to the present invention.
Figure 4:
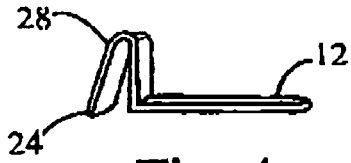
FIG. 4 is a side view of the marker device of the present invention.

In the embodiment illustrated in FIG. 2, mounting member 16 is securely locked to the rim 21 of a metal can 20. Mounting member 16 is preferably formed of a lightweight plastic or plastic-like substance which allows for easy mounting on a base structure due to the malleability of the plastic. This also results in easy removal of the marker device 10 from the rim 21 without breakage of the mounting member 16. Placement of the marker device 10 on the rim 21 is effected by grasping tab member 12 and gently placing the underside 24 of the mounting member 16, as shown in FIGS. 3 and 4, over the outer surface of rim 21. The marker device 10 is easily removed from the outer rim 21 of the can 20 by grasping the tab member 12 and pulling up gently, thereby releasing the mounting member 16 from the rim 21. Mounting member 16 is preferably arcuate in shape so as to conform to rim 21 as seen in FIG. 3. Mounting member 16 can be sized accordingly during manufacture to conform or mount to various base structures.

Figure 5:
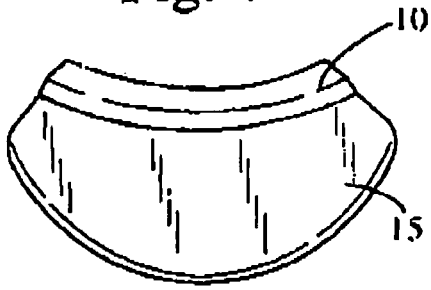
FIG. 5 is a top plan view of a marker device according to the present invention.
Figure 6:
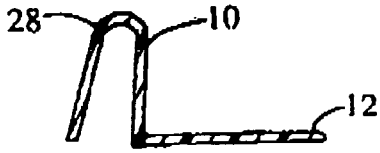
FIG. 6 is a cross-sectional view of the marker device of the present invention.

As seen in FIGS. 3 and 4, the undersurface of the mounting member 24 may comprise a smooth inner surface with a rounded upper portion 28, as shown in FIGS. 4 and 6. FIG. 3 also shows the flat, lower surface 18 of tab member 12. FIG. 5 demonstrates the flat, upper surface 15 of tab member 12 which performs a dual function. The first function of tab member 12 is to allow for easy grasping of the device 10 for placement and removal from a base structure. As demonstrated in FIG. 4, the location of the tab member 12 is such that grasping with thumb and forefinger for placement and removal of the mark 10 is easily accomplished. The second function of tab member 12 is the presentation of a visual surface on upper surface 15 of Lab member 12, whereby shapes, colors and various other indicia placed on the tab surface 15 allow for easy visual identification by an owner.

The marker device is preferably composed of plastic or plastic-like material but may also be composed of metal, having limited resiliency and sufficient strength and stiffness to allow for secure locking on a base structure.

Figure 7:
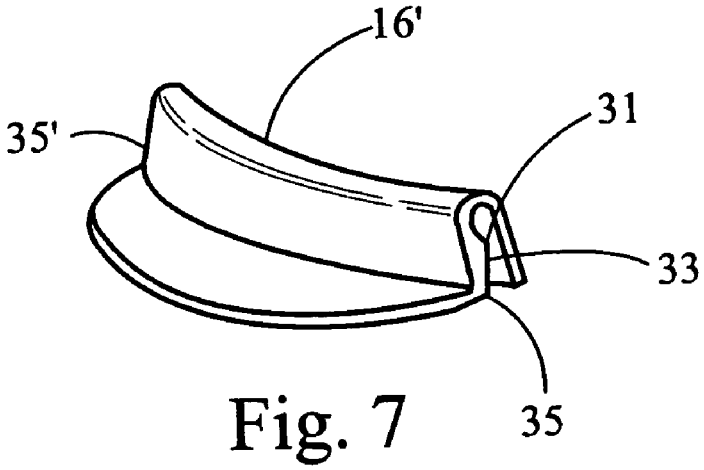
FIG. 7 is a front perspective view of an alternative embodiment of the present invention.
Figure 8:
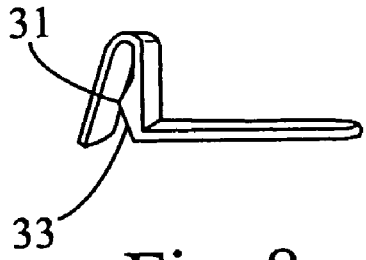
FIG. 8 is a side view of an alternate embodiment of the present invention.
Figure 9:
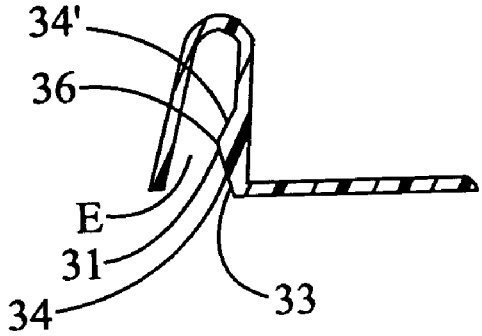
FIG. 9 is a cross-sectional view of an alternative embodiment of the present invention.

FIG. 6 demonstrates through crosssectional view the thickness of the marker device 10. The device is of uniform thickness throughout. Alternatively, as shown in FIGS. 7, 8 and 9, a modified form of mounting member 16' may include a thickened portion 31 extending laterally from an inner surface 33 of the mounting member 16'. The portion 31 comprises sloped surfaces 34, 34' intersecting at apex 36. The portion 31 is disposed on opposite ends of the side edges 35, 35' of said mounting member 16', reducing the width of the entrance E. The mounting member 16', including portion 31, is placed over a beaded rim K, as shown in FIG. 2, with portion 31 securely locking underneath the beaded rim R. This allows the device 38 to be securely attached to rim R and to prevent slippage of the device while tipping the can 20.

Figure 10:
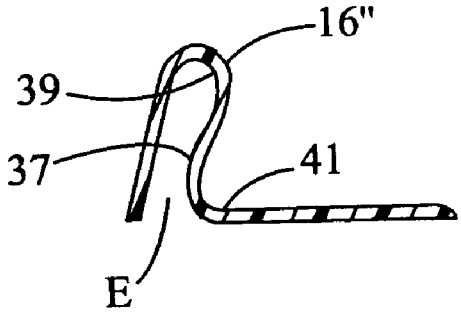
FIG. 10 is a cross-sectional view of another alternative embodiment of the present invention.

Mounting member 16" in another modified form may also include a sloped side wall 37 extending downwardly and outwardly from rounded upper portion 39 as shown in FIG. 10. The device 41 is of uniform thickness throughout with the sloped side wall 37 creating a narrowed entrance E so that the mounting member 16" can be placed over a beaded rim. The upper portion 39 is then seated against the beaded rim to prevent the device 41 from moving on the rim.

There are many ways of distinguishing the marker device including manufacturing the device in sets of different colors or having indicia printed on the upper surface of the tab member 12. Shapes, colors and/or markings of the marker device provide for distinction and for identification purposes. This can also be very useful with children who can be given a color and asked to look for that color when they are trying to locate their beverage. The marker device 10 may be manufactured in sets of different colors so that packages of the device 10 may be used, providing to each individual a different color device. A package may contain different color marker devices so that individuals may distinguish their marker from the marker of another individual.

Once the marker device 10 is placed on the base structure, it will stay in place until removed. The tab member is designed to lay generally perpendicular to the base structure resulting in easy visual identification.

It is therefore to be understood that while preferred forms form of invention are herein set forth and described, various modifications and changes may be made therein without departing from the spirit and scope of the present invention as defined by the appended claims and reasonable equivalents thereof.

I claim:

1. A marker for identifying a container having a circular drinking edge, comprising:

an arcuate mounting member having first and second side edges and a lower edge having an exterior convex surface portion, said exterior convex surface portion extending between said first and second side edges, said mounting member adapted to be releasably secured along a portion of said drinking edge of said container with said exterior convex surface portion disposed outside of said container; and a tab member extending along a substantial length of said said exterior convex surface portion between said first and second side edges, said tab member defined by a thin, substantially flat crescent-shaped portion, said crescent-shaped portion extending in a circumferential direction beneath a portion of said drinking edge when said mounting member is secured to said edge, and said crescent-shaped portion extending laterally outwardly from said exterior convex surface portion of said mounting member and having a visibly distinguishable, outwardly extending surface.

2. A marker according to claim 1 wherein said mounting member is of inverted channel-shaped configuration.

3. A marker according to claim 1 wherein said mounting member is defined by two opposing walls joined together at upper edges thereof to define an inverted channel-shaped member capable of mounting securely on said circular drinking edge of said container.

4. A marker according to claim 3 wherein said channel-shaped member has an entrance of reduced width.

5. A marker according to claim 4 wherein said channel-shaped member includes a thickened portion at opposite ends of an inner surface of one of said opposing walls.

6. A marker according to claim 1 wherein said mounting member and said tab member are composed of a stiff, resilient material.

7. A marker according to claim 1 wherein said mounting member and said tab member are composed of a plastic material.

8. A beverage can identification marker wherein said can has a drinking edge that extends circumferentially, said marker comprising:

an arcuate mounting member of inverted channel-shaped configuration having first and second side edges and having an exterior convex surface portion, said exterior convex surface portion extending between said first and second side edges, said mounting member adapted to be releasably secured along a portion of said drinking edge of said beverage can with said convex surface portion disposed outside of said can; and a crescent-shared tab member extending circumferentially and laterally outwardly from said exterior convex surface portion and along a substantial length of said lower edge between said first and second side edges.

9. A beverage can identification marker according to claim 8 wherein said tab member has a visibly distinct, outwardly extending surface portion.

10. A marker according to claim 1 wherein said marker bears indicia which visually identifies and distinguishes said marker.

* * * * *